US010619375B2

(12) United States Patent
Hanley

(10) Patent No.: US 10,619,375 B2
(45) Date of Patent: Apr. 14, 2020

(54) HOVERING AIR FORT

(71) Applicant: Luciana E. Hanley, Rancho Santa Fe, CA (US)

(72) Inventor: Luciana E. Hanley, Rancho Santa Fe, CA (US)

( * ) Notice: Subject to any disclaimer, the term of this patent is extended or adjusted under 35 U.S.C. 154(b) by 21 days.

(21) Appl. No.: 15/750,225

(22) PCT Filed: Aug. 6, 2016

(86) PCT No.: PCT/US2016/045926
§ 371 (c)(1),
(2) Date: Jun. 6, 2018

(87) PCT Pub. No.: WO2017/024291
PCT Pub. Date: Feb. 9, 2017

(65) Prior Publication Data

US 2019/0234098 A1 Aug. 1, 2019

Related U.S. Application Data

(60) Provisional application No. 62/201,987, filed on Aug. 6, 2015.

(51) Int. Cl.
*E04B 1/34* (2006.01)
*E04H 15/22* (2006.01)
*E04H 15/00* (2006.01)

(52) U.S. Cl.
CPC ..... *E04H 15/22* (2013.01); *E04H 15/006* (2013.01)

(58) Field of Classification Search
CPC ..... E04H 15/006; E04H 15/22; Y10S 52/13; E04B 1/32
USPC ..... 52/2.11, 2.22, DIG. 13, 2.17, 2.18, 81.2, 52/79.4; 135/125, 93
See application file for complete search history.

(56) References Cited

U.S. PATENT DOCUMENTS 3,335,529 A * 8/1967 Gedney ..... E04H 15/22 52/2.14
4,164,829 A * 8/1979 Sadler ..... E04H 1/125 135/117
5,462,505 A * 10/1995 Blair ..... A63B 5/11 472/134
5,566,512 A * 10/1996 Page ..... E04H 15/22 52/2.11
5,916,097 A * 6/1999 Markuten ..... E04B 1/3205 52/460
5,970,661 A * 10/1999 Bishop ..... E04H 15/006 135/125
6,119,408 A * 9/2000 Page ..... E04H 15/22 52/2.17
6,266,927 B1 * 7/2001 Leslie ..... E04H 15/22 52/2.17

(Continued)

*Primary Examiner* — Chi Q Nguyen
(74) *Attorney, Agent, or Firm* — David B. Waller

(57) ABSTRACT

A hovering air fort containing a circular side panel having an aperture, a domed top, a shroud having a first end secured to the circular side panel to provide an air flow channel for forcing air through the aperture and a second end for receiving a fan; and a single chord secured at the bottom edge of the circular side panel. The chord may be secured along about 75% to 100% of the bottom edge of the circular side panel and has a weight that allows the bottom edge to be lifted above the surface when the fan forces air into the hovering air fort.

10 Claims, 2 Drawing Sheets

(56) References Cited

U.S. PATENT DOCUMENTS

| | | | | |
|---|---|---|---|---|
| 6,397,869 | B1 * | 6/2002 | Jennings | E04H 15/14 135/120.1 |
| 6,875,119 | B2 * | 4/2005 | Murphy | E04H 15/22 472/134 |
| 8,479,452 | B2 * | 7/2013 | Page | E04H 15/22 52/2.17 |
| 9,528,291 | B2 * | 12/2016 | Jorba | E04H 15/22 |
| 9,901,840 | B2 * | 2/2018 | Hollowell | A63H 33/008 |

* cited by examiner

HOVERING AIR FORT

CROSS-REFERENCE TO RELATED APPLICATIONS

This application claims priority to U.S. Provisional Application Ser. No. 62/201,987, filed on Aug. 6, 2015, both of which are incorporated herein in their respective entirety by this reference.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention relates generally to play structures for children. More specifically, a play structure with no base that maintains its configuration by the flow of air directed into the structure by a device such as a household fan.

BACKGROUND OF THE INVENTION

Most children have built forts that are places specifically for themselves in which to play. These structures, in their simplest form, are made of household furniture with cloth coverings such as blankets and sheets draped over the furniture to create the enclosure. More elaborate structures are constructed of building materials and may be constructed to resemble small homes with foundations on the ground or in some cases in living trees. Similar structures, made of collapsible panels, are described in U.S. Pat. Nos. 5,313,747 and 5,706,613. Another structural configuration is that of an igloo is disclosed in U.S. Pat. No. 5,715,854. In addition, structures made of inflatable elements have also been disclosed. In U.S. Pat. No. 5,145,440 a cabin is constructed of inflatable interlocking simulated logs. Similarly U.S. Pat. No. 5,273,477 describes inflatable blocks with interlocking tongue and groove that may be stacked to create a structure.

Another structure described in U.S. Pat. No. 5,970,661 describes and inflatable tent constructed of air permeable fabric with a shroud on one end to receive a household fan and a plurality of anchor weights along the perimeter edge that may be adjusted to create different shaped configurations of the tent. These weights are of sufficient weight to secure the structure on a flat surface while maintaining the desired configuration of the structure. They are inserted into cylindrical pockets formed at the free edges of the middle and side panels. Children enter and exit the structure by lifting an edge and climbing under it. Unfortunately, this invention can be difficult for a child to enter or exit depending on the location of the weights, potential shifting of the weights in their cylindrical pockets or relocation of the weights will change the desired shape of the structure and, as a whole, the inflated structure cannot be moved or relocated easily on a flat surface when in use without moving each of the weights or deflating the structure.

Consequently, there is a need for a inflatable structure that is easily entered from all locations along the perimeter edge of the structure, that maintains its desired shape and can be easily moved or rotated on a flat surface easily when fully inflated.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of a hovering air fort. The present invention is an air fort that comprises: a front panel formed with a hole and having two opposite edges of a height H and two opposite edges of a width W; a rear panel having two opposite edges of the height H and two opposite edges of a length W; a first side panel having two opposite edges of height H and two opposite edges of length L; a second side panel having two opposite edges of the height H and two opposite edges of the length L; a top panel having two opposite edges of the width W and two opposite edges of the length L, wherein the two opposite edges of width W of the top panel are each respectively joined to an edge of the width W on the front panel and to an edge of the width W on the rear panel, and wherein the two opposite edges of length L of the top panel are each respectively joined to an edge of the length L on the first side panel and to an edge of the length L on the second panel, and further wherein the front panel is positioned between and is joined to the first side panel and to the second side panel at respective edges of height H, and the rear panel is positioned between and is joined to the first side panel and to the second side panel at respective edges of height H, to form an unstructured cover having an opening defined by a periphery surrounding the opening; a chord hemmed into the cover at the periphery of the opening around the opening; and a means for continuously forcing air through the hole in the front panel to provide structure and lift for the cover when the hemmed opening is positioned against an external surface to create the air fort.

In this aspect of the present invention, the means for continuously forcing air may include a fan and a shroud engaged between the fan and the hole in the front panel to establish a channel for air flow for forcing air with the fan from outside the cover and through the hole in the front panel to over pressure air inside the structure cover.

Another embodiment of the present invention is a hovering air fort for inflating on a surface comprising: a circular side panel having an aperture, a top edge and a bottom edge; a domed top panel having a peripheral edge, the peripheral edge joined to the top edge of the circular panel; a shroud having a first end secured to the circular side panel to provide an air flow channel for forcing air through the aperture and a second end for receiving a fan; and a single chord secured at the bottom edge of the circular side panel, wherein the chord is secured along about 75% to 100% of the bottom edge of the circular side panel, the chord having a weight that allows said bottom edge to be lifted above the surface when the fan forces air into the air fort.

In one embodiment of this aspect of the invention, the first end of the shroud may be secured to the circular side panel by stitching, snaps, a zipper, or Velcro™. In addition, the second end of the shroud may further comprise snaps, a cinch chord, straps or Velcro™ to secure a fan to the air fort. Further, the chord may be secured at the bottom edge of the circular side panel by stitching or Velcro™.

In another embodiment the circular side and/or top panel and/or domed top panel of the hovering air fort may further comprises a viewing port. The viewing port may be made of transparent fine mesh netting that provides resistance to escaping air from the fort and does not affect maintaining its inflation.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures and systems for carrying out the several purposes of the present disclosed device. It is important, therefore, that the claims be regarded as including such equivalent construction and methodology insofar as they do not depart from the spirit and scope of the present invention.

The objects, features, and advantages of the invention will be brought out in the following part of the specification, wherein detailed description is for the purpose of fully disclosing the invention without placing limitations thereon.

DETAILED DESCRIPTION OF THE INVENTION

Figure 1:
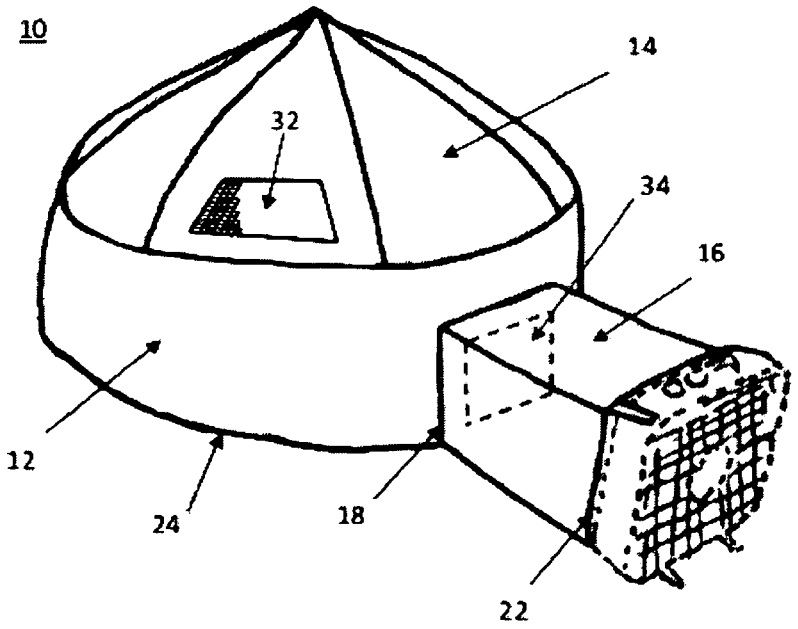
FIG. 1 shows a perspective view of a circular hovering air fort 10 of the present invention in its inflated configuration.
Figure 2:
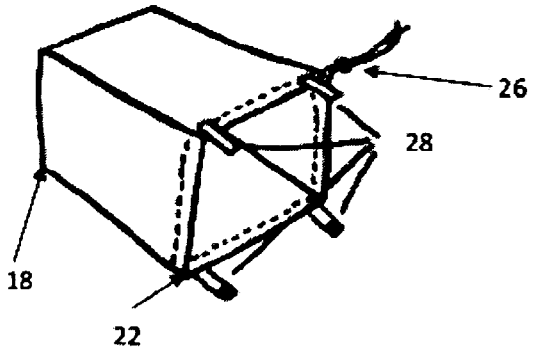
FIG. 2 shows a perspective view of the shroud for connecting the hovering air fort in fluid communication with a fan or other source of air that may be used to inflate the hovering air fort.
Figure 3:
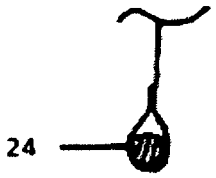
FIG. 3 shows a cross sectional view of a chord secured along the bottom edge of the circular side panel.
Figure 4:
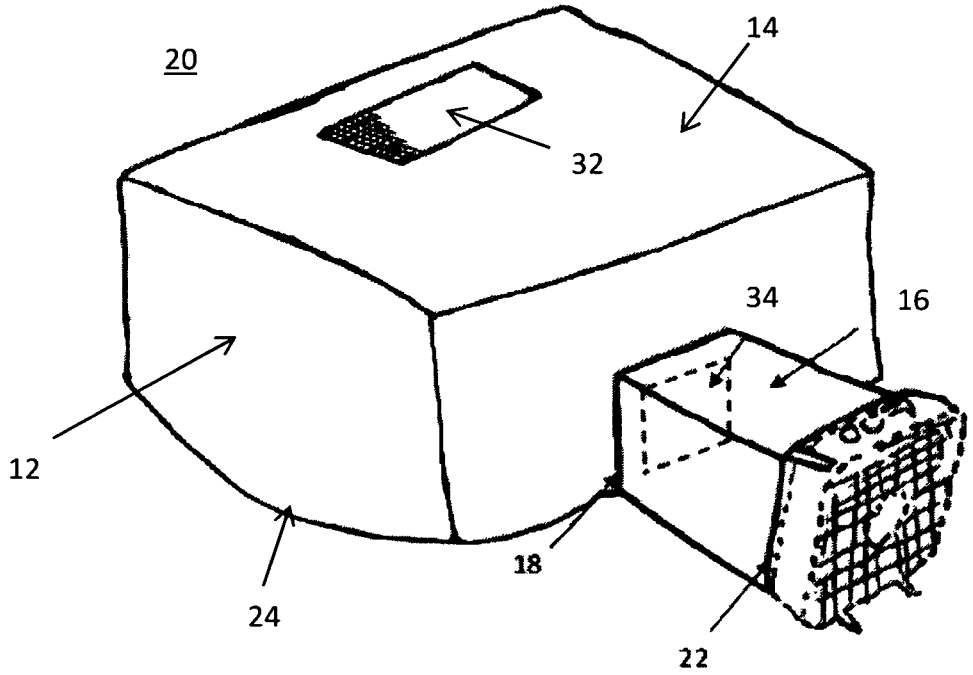
FIG. 4 shows a perspective view of a rectangular hovering air fort 20 of the present invention in its inflated configuration.
Figure 5:
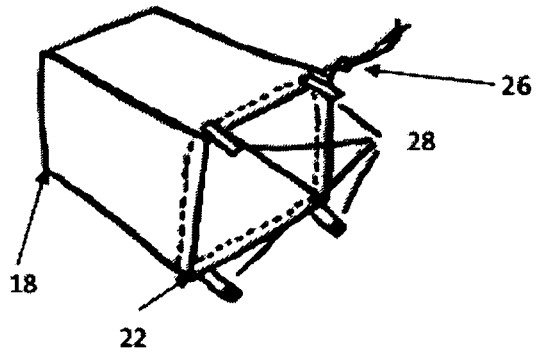
FIG. 5 shows a perspective view of the shroud for connecting the hovering air fort in fluid communication with a fan or other source of air that may be used to inflate the hovering air fort of FIG. 4.
Figure 6:
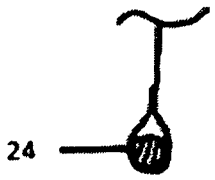
FIG. 6 shows a cross sectional view of a chord secured along the bottom edge of the rectangular side panel.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "joined" as used herein refers to the connecting of one or more panels of material that make up the hovering air fort of the present invention. This term includes stitching, fusing temperature sensitive material through heat and/or the use of an adhesive. These are just a few methods of fastening one or more pieces of fabric, cloth or textile to one another and will include other methods known to those skilled in the art.

The term "secured" as used herein refers to the affixing of the shroud to the circular side panel or the front panel over the aperture or hole respectively. This term includes stitching, fusing temperature sensitive material through heat, the use of an adhesive, a zipper and/or Velcro™. These are just a few methods of affixing the shroud to the circular side panel or the front panel and will include other methods known to those skilled in the art.

The term "hole" and/or "aperture" are used synonymously to refer to an opening provided in the side of the air fort to channel air flow from the means for forcing air into the structure. This hole or aperture may be provided in a variety of sizes that allows sufficient fluid communication with the air fort to allow the structure to hover over a surface on which it is inflated.

The term "hover" as used herein refers to the ability for the present invention to be inflated over a surface and remain positioned over that surface with no or minimal contact with the surface itself. In essence, the air fort is raised above the surface resulting from the air escaping the bottom edge of the structure uniformly. This unique construction allows the air fort to be easily moved over the surface by turning or lifting and relocating the means for forcing air (e.g., a fan).

The present invention is a hovering air fort that can be constructed in a variety of configurations. Two of these many configurations are elaborated here. In the first configuration the air fort comprises: a front panel formed with a hole and having two opposite edges of a height H and two opposite edges of a width W; a rear panel having two opposite edges of the height H and two opposite edges of a length W; a first side panel having two opposite edges of height H and two opposite edges of length L; a second side panel having two opposite edges of the height H and two opposite edges of the length L; a top panel having two opposite edges of the width W and two opposite edges of the length L, wherein the two opposite edges of width W of the top panel are each respectively joined to an edge of the width Won the front panel and to an edge of the width W on the rear panel, and wherein the two opposite edges of length L of the top panel are each respectively joined to an edge of the length L on the first side panel and to an edge of the length L on the second panel, and further wherein the front panel is positioned between and is joined to the first side panel and to the second side panel at respective edges of height H, and the rear panel is positioned between and is joined to the first side panel and to the second side panel at respective edges of height H, to form an unstructured cover having an opening defined by a periphery surrounding the opening; a chord hemmed into the cover at the periphery of the opening around the opening; and a means for continuously forcing air through the hole in the front panel to provide structure and lift for the cover when the hemmed opening is positioned against an external surface to create the air fort. Air flow for inflating the air fort can be provided by a fan and a shroud engaged between the fan and the hole in the front panel to establish a channel for air flow for forcing air with the fan from outside the cover and through the hole in the front panel to over pressure air inside the structure cover.

In another configuration the hovering air fort comprises a circular side panel having a an aperture, a top edge and a bottom edge; a domed top panel having a peripheral edge, the peripheral edge joined to the top edge of the circular panel; a shroud having a first end secured to the circular side panel to provide an air flow channel for forcing air through the aperture and a second end for receiving a fan; and a single chord secured at the bottom edge of the circular side panel, wherein the chord is secured along about 75% to 100% of the bottom edge of the circular side panel, the chord having a weight that allows said bottom edge to be lifted above the surface when the fan forces air into the air fort.

I. Panels

The panels are made of a light weight material or fabric and form the ceiling 14 and side walls 12 of the hovering air fort 10 and 20. The fabric selected allows for the passage of air so that a child can breathe without difficult through the fabric in the event that air flow from the fan fails and the fabric settles on the surface. The fabric that may be utilized with the present invention can be determined by those skilled in the art. Preferably, if a person can breathe, without difficulty, through at least three layers of the fabric then the fabric is sufficiently permeable and suitable for use. In one embodiment, the fabric utilized is a polyester fabric having 190 thread count (190T) and 70 Denier (70D) which is a measure of the linear mass density of the material used to construct the fabric. Other materials known to those skilled in the art may be utilized that provide similar thread count and Denier ratings.

The hovering air fort 10 may be provided in a variety of configurations. In the first configuration described above the fort 10 is rectangular in shape and in the second it is cylindrical. In either configuration the panels may comprise one or more translucent panels or viewing ports 32 (i.e., windows) made of a fine mesh netting that maintains resistance to air flow that has no or minimal effect on the ability to inflate or maintain the structure in its inflated form. One skilled in the art can determine what netting materials would be suitable for this purpose by measuring their air permeability and compare that to the material used for the panels or by incorporating the translucent panels into the structure and testing for inflation and maintaining inflation during use.

A hole or aperture 34 is provided in the front panel and the circular side panels 12 to provide an opening through which air can be forced to inflate the structure. This hole or aperture 34 should be of a diameter or size that allows a sufficient volume of air to be forced into the structure maintaining its configuration and raising the base just above the surface during use. In one embodiment, the hovering air fort 10 is inflated using a 20 inch box fan having an air flow of 3.3 cubic feet per second on the low setting, 4.6 cubic feet per second on medium and 6.0 cubic feet per second on high. The hole or aperture 34 utilized with this type of fan is about the same width and height of the fan.

The hole or aperture 34 may be covered with an open netting or mesh that does not significantly restrict air flow but does prevent an individual from reaching a hand or other object into or near the fan.

The bottom edge of the circular side panel 12 and/or the front, rear and both side panels depending on the configuration may provide a method for incorporating a chord 24 which provides tension to keep the walls of the fort 10 relatively taught yet allow the bottom edge to be lifted above the surface when air is forced into the structure. More specifically, the chord 24 does not provide weight that anchors the sides of the structure to the ground preventing easy movement of the entire structure simultaneously. The weight is merely enough to keep the wall taught and allow air to escape along the entire bottom edge preventing the bottom edge from contacting the ground. This method may include a sleeve along about 75% to 100% of the bottom edge in which the chord 24 can be inserted and housed, a series of snaps or Velcro™ along the bottom that can be folded over the chord 24 and secured maintaining the chord 24 in the sleeve it creates, or the chord 24 can be sewn into the bottom edge of the panels.

The rear and/or side panels or the circular side panel may further comprise passageways or tubes with connecting means to allow one hovering air fort to be connected to another hovering air fort. This can be provided in a variety of configurations. The rear and/or side panels or the circular side panel may comprise one or more closable openings to which the passageway(s) or tube(s) may be secured by each end to the two hovering air forts. These passageways or tubes can be separate from the hovering air forts with the passageways or tubes having connection means on each end, such as a zipper or Velcro™, for securing to the perimeter edges of the closable opening(s). Alternatively, they may be secured to the closable opening(s) on the hovering air fort by, for example, sewing or adhesive. In this configuration, they may be exposed on the exterior of the rear and/or side panels or the circular side panel or they may be housed within a pocket having cover formed in the exterior of the hovering air fort. In use, the cover is opened and the passageway or tube may be unfurled and ready for connecting to a second hovering air fort. Once connected the closable openings are opened on both hovering air forts to allow for fluid connection between both forts.

II. Shroud

The shroud 16 can be made of the same or different material as the panels and preferably meets the same criteria, allowing a person to breath without difficulty through three layers of the material, as elaborated above for the selection of panel material. The shroud 16 has a first end 18 that affixes to the air fort and a second end 22 that affixes to a means for forcing air into the air fort 10. It may be provided in a variety of shapes including rectangular or circular and its size will depend on the diameter of the hole or aperture in the front panel or circular side panel 12 respectively.

In one embodiment, the shroud 16 has the same configuration as the housing of a fan used to force air into the air fort. Correspondingly, the shroud 16 could be larger than the housing of a fan to allow a number of different fans to be used in inflating the air fort 10. In this configuration, the end of the shroud that affixes the fan to the air fort 22 may have connectors that allow it to be formed about the housing of the fan, such as a cinch cord 26, straps or Velcro™ 28. When using a cinch cord 26, the second end 22 may further comprise a small hood that envelopes the perimeter of the fan such that when the cinch chord 26 is drawn it overlaps the back of the fan and secures it within the shroud 16.

In another embodiment, the end of the shroud 16 that is affixed to the front panel or circular side panel 12 may be connected by a variety of methods including stitching, snaps, a zipper or Velcro™. In addition, the first end 18, the second end 22 or both ends could further comprise an open mesh netting that does not significantly affect the air forced into the air fort 10 for inflation but prevents or interferes with reaching a hand or other object through the shroud 16 to the fan.

III. Chord

The chord 24 may be made of a variety of linearly uniform materials such as rope, cable, a flexible tube or chain and of a weight that maintains the walls and/or side walls of the air fort taught but does not prevent air from escaping from the bottom edge. Such materials can be measured to determine their weight per linear foot and based on the size of the structure desire, the power of the air flow to be supplied, the number of cubic feet being forced into the structure, the total length of the bottom edge and the weight of the structure itself, one skilled in the art can prepare a generally linear graph of the weight required versus the cubic area of the air fort to determine the appropriately weighted chord 24 to use for a particular sized air fort 10. While this may take some routine experimentation one skilled in the art would be able to accomplish this determination without undue experimentation.

The chord 24 may be secured to the bottom edge of the air fort 10 by a variety of methods. These may include a sleeve along the bottom edge in which the chord 24 can be inserted and housed, a series of snaps or Velcro™ along the bottom edge that can be folded over the chord 24 to securely maintain the chord 24 in the sleeve created, or the chord 24 can be sewn into the bottom edge of the panel or panels. Further the chord 24 may be incorporated along the entire length of the bottom edge or just a portion. Preferably, the chord 24 is secured along about 75% to 100% of the bottom edge of the air fort.

IV. Air Forcing Means

The air forcing means may be any device that provides the desired cubic foot air flow to inflate an air fort 10 of a desired size maintaining the bottom edge just above the surface or ground. Popular air forcing means commercially available are fans, which come in a variety of shapes and sizes. While many of the fans can be adapted to provide the air flow desired for the present invention the common 20 inch box fan (Lasko 20 Inch Box Fan (B20200), Walmart Bentonville Ak., Holmes Box Fan 20" (HBF2002A-W), Target Minneapolis, Minn., Air King 20" Box Fan (G3328682) Zoro, Inc., Buffalo Grove Ill.) with three settings is particularly easy to use. The low setting provides 3.3 cubic feet of air per second, the medium setting provides 4.6 cubic feet of air per second and the high setting provides 6.0 cubic feet of air per second.

V. Preparation

Table 1 contains information for the general construction parameters for preparing a variety of sizes of a hovering air fort of the configuration provided in FIG. 1.

TABLE 1 [1]

| | Fort Volume ($Ft^3$) | | | | |
|---|---|---|---|---|---|
| | 60 | 80 | 100 | 200 | 275 |
| Fort Weight (Oz.) | 23 | 27 | 31 | 36 | 42 |
| Length of Perimeter Weighting (Ft) | 18.5 | 21.2 | 23 | 26.5 | 34 |
| Minimum Chord Weight for Vertical Stability (Oz) | 4.6 | 5.4 | 6.2 | 7.2 | 8.4 |
| Maximum Chord Weight for Mobile Hovering (Oz) | 6.9 | 8.1 | 9.3 | 10.8 | 12.6 |

TABLE 1 [1]-continued

| | Fort Volume ($Ft^3$) | | | | |
|---|---|---|---|---|---|
| | 60 | 80 | 100 | 200 | 275 |
| Fan Output ($Ft^3$/sec) | 3.3 | 3.3 | 3.3 | 4.6 | 4.6 |
| Aperture Size 20" Box Fan (Inches) | 20" × 20" | 20" × 20" | 20" × 20" | 20" × 20" | 20" × 20" |
| Window Size (Inches) [2] | 26" × 12" | 26" × 12" | 26" × 12" | 26" × 12" | 26" × 12" |

[1] This chart is for a hovering air fort whose center of gravity does not exceed 50% of its height.
[2] Window size is for a permeable organza material.

VI. Use

The hovering air fort is maintained in a cinch bag which is uncinched and the hovering air fort removed and laid flat on the floor. If the shroud is not attached the user affixes the shroud to the panel over the hole or aperture. The other end of the shroud is then affixed to a box fan in this example. Depending on the type of connectors the shroud may be secured by Velcro™ tabs, or a hood with a draw string cinch. Once the connections are secured and the fan is in place, the fan is activated and the air fort inflates. In one embodiment, the volume of the air fort is 60 Cubic feet including the shroud volume and has a weight of 23 ounces including the chord. With a 20 inch box fan on the low setting the hovering air fort inflated in 18 seconds, on the medium setting it inflates in 13 seconds and on the high setting it inflates in 10 seconds. In this configuration, efficient hovering occurs when the chord weighting is distributed evenly along the bottom edge and is no less than 20% of the total weight of the air fort. Once the hovering air fort is inflated it may be move to the desired location on the surface by grasping the handle on the top of the 20 inch box fan and shifting the fan to the appropriate location. The air fort will remain inflated, will move with the fan and readjust itself to its normal orientation with respect to the fan when the fan is stationary. Fine adjustment of the hovering air fort can be accomplished by merely turning the fan. The air fort will follow the fan movement and readjust itself to its normal orientation with respect to the fan during the movement or when the movement is completed. The balance between the perimeter weighting, the size of the air fort, the volume of air being forced into the fort and the weight of the panels that comprise the fort permit the fort to maintain stability and hover simultaneously.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A hovering air fort comprising:

a front panel formed with an aperture and having two front panel opposite edges of a height H and two front panel opposite edges of a width W;

a rear panel having two rear panel opposite edges of said height H and two rear panel opposite edges of said length W;

a first side panel having two first side opposite edges of said height H and two first side opposite edges of a length L;

a second side panel having two second side opposite edges of said height H and two second side opposite edges of said length L;

a top panel having two top panel opposite edges of said width W and two top panel opposite edges of said length L, wherein said two top panel opposite edges of said width W are each respectively joined to an edge of said width W on said front panel and to an edge of said width W on said rear panel, and wherein said two top panel opposite edges of said length L are each respectively joined to an edge of said length L on said first side panel and to an edge of said length L on said second panel, and further wherein said front panel is positioned between and is joined to said first side panel and to said second side panel at respective edges of said height H, and said rear panel is positioned between and is joined to said first side panel and to said second side panel at respective edges of said height H, to form an unstructured cover having an opening defined by a periphery surrounding said opening; and a chord hemmed into said unstructured cover at said periphery of surrounding said opening, wherein said chord having a weight that allows said periphery surrounding said opening to be lifted above a surface when air is forced into said hovering air fort through said aperture in said front panel; and wherein said air forced through said aperture in said front panel provides lift for said cover when said hemmed opening is positioned against said surface.

2. The hovering air fort according to claim 1, comprising:

a shroud that surrounds said aperture in said front panel to establish a channel for air flow into said cover.

3. The hovering air fort according to claim 2, further comprising a fan.

4. The hovering air fort according to claim 2, further comprising a viewing port on one or more of said rear panel, said first side and/or said second side, wherein said viewing port is made of transparent fine mesh netting and wherein said transparent fine mesh netting provides resistance to escaping air from said fort and does not affect maintaining inflation of said hovering air fort.

5. A hovering air fort for inflating on a surface comprising:

a circular side panel having an aperture, a top edge and a bottom edge;

a domed top panel having a peripheral edge, said peripheral edge joined to said top edge of said circular panel;

a shroud having a first end secured to said circular side panel wherein said shroud surrounds said aperture to provide an air flow channel for forcing air through said aperture and a second end for receiving a fan; and a single chord secured at said bottom edge of said circular side panel, wherein said chord is secured along about 75% to 100% of said bottom edge of said circular side panel, said chord having a weight that allows said bottom edge to be lifted above said surface when said fan forces air into said hovering air fort.

6. A hovering air fort according to claim 5, wherein said shroud is secured to said circular side panel by stitching, snaps, a zipper, or Velcro™.

7. A hovering air fort according to claim 5, wherein said second end of said shroud comprises snaps, a cinch chord, or Velcro™ to secure a fan to said hovering air fort.

8. A hovering air fort according to claim 5, wherein said chord is secured at said bottom edge of said circular side panel by stitching or Velcro™.

9. A hovering air fort according to claim 5, wherein said circular side panel or said domed top panel further comprises at least one viewing port.

10. A hovering air fort according to claim 5, wherein said viewing port is made of transparent fine mesh netting and wherein said transparent fine mesh netting provides resistance to escaping air from said hovering air fort and does not affect maintaining inflation of said hovering air fort.

* * * * *